US008579655B2

(12) United States Patent
Kawamura

(10) Patent No.: US 8,579,655 B2
(45) Date of Patent: Nov. 12, 2013

(54) DEVICE CONNECTOR

(75) Inventor: Masayuki Kawamura, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 13/449,677

(22) Filed: Apr. 18, 2012

(65) Prior Publication Data

US 2012/0282789 A1 Nov. 8, 2012

(30) Foreign Application Priority Data

May 6, 2011 (JP) ..... 2011-103585

(51) Int. Cl.
*H01R 31/08* (2006.01)

(52) U.S. Cl.
USPC ..... 439/509; 439/533; 439/353

(58) Field of Classification Search
USPC ..... 439/509, 533, 911, 248, 353
See application file for complete search history.

(56) References Cited

U.S. PATENT DOCUMENTS

| | | | | |
|---|---|---|---|---|
| 6,056,592 | A * | 5/2000 | Hashizawa et al. | 439/509 |
| 6,905,375 | B2 * | 6/2005 | Ikeda | 439/801 |
| 8,342,880 | B2 * | 1/2013 | Kato et al. | 439/595 |
| 2010/0255728 | A1 | 10/2010 | Matsuoka et al. | |

* cited by examiner

*Primary Examiner* — Phuong Dinh
(74) *Attorney, Agent, or Firm* — Gerald E. Hespos; Michael J. Porco; Matthew T. Hespos

(57) ABSTRACT

A device connector (10) includes a service cover (30) to close a service hole (22) on a case (20). A case-side connector (60) is arranged in the case (20) and mounted in a mounting recess (42) in a terminal block (40). A cover-side connector (50) is provided integrally to the service cover (30) and is connected to the case-side connector (60) in a waiting state to form an interlock circuit when the service cover (30) is mounted on the case (20). Flexible pieces (65) hold the case-side connector (60) with a clearance (CL) between the case-side connector (60) and the inner wall of the mounting recess (42) when the case-side connector (60 is in the waiting state. On the other hand, the flexible pieces (65) bias the case-side connector (60) to return the case-side connector (60) to the waiting state when the clearance (CL) changes.

10 Claims, 13 Drawing Sheets

DEVICE CONNECTOR

BACKGROUND OF THE INVENTION

1. Field of the Invention

The invention relates to a device connector in a case of a device in a vehicle, the case being formed with an opening used to perform a bolt tightening operation for a terminal block in the case.

2. Description of the Related Art

U.S. Patent Application Publication No. 2010/0255728 discloses a device connector in a case of a device. A tightening tool is inserted through an opening in the case through to tighten bolts so that terminals of busbars or the like can be connected electrically conductively. A service cover is mounted on the case to close the opening after the bolt tightening operation is completed so that water, dust and the like do not enter the case through the opening.

An interlock circuit switches an electrical circuit in the device to an OFF state as a safety measure when the service cover is removed from the case even though the terminals are in an electrically conductive state. Specifically, the interlock circuit is formed and the electrical circuit is switched to an ON state by connecting a cover-side connector on the service cover and a case-side connector in the case. On the other hand, the interlock circuit is cut off and the electrical circuit is switched to the OFF state when the service cover is removed from the case.

Several tightening portions may be arranged on one terminal block in the above-described device connector. Openings could be provided in one-to-one correspondence with the tightening portions. However, a separate service cover then would be required for each opening, thereby making a mounting operation cumbersome. A common opening could be provided for several tightening portions and one service cover could be provided for covering the opening. However, the larger service cover is more likely to be misaligned during mounting on the case. The interlock circuit may not be formed if the connectors on the cover and the case are not aligned properly.

The present invention was completed based on the above situation and an object thereof is to connect a cover-side connector and a case-side connector precisely by absorbing a misalignment in mounting a service cover on a case.

SUMMARY OF THE INVENTION

The invention relates to a device connector in a case of a device in a vehicle. The case has an opening used for a bolt tightening operation for a terminal block in the case and a service cover is mountable on the case to close the opening. A case-side connector is mounted in a mounting recess in the terminal block in the case. A cover-side connector is provided integrally on the service cover and is connected to the case-side connector in a waiting state to form an interlock circuit when the service cover is mounted on the case. A biasing member holds the case-side connector to secure a clearance between the case-side connector and the inner wall of the mounting recess when the case-side connector is in the waiting state. On the other hand, the biasing member biases the case-side connector to return to the waiting state when the clearance changes.

The service cover may be misaligned during mounting onto the case. However, the case-side connector in the waiting state will move within the range of the clearance to absorb the misalignment and to become coaxial with the cover-side connector. In this way, the cover-side connector and the case-side connector form the interlock circuit and an electrical circuit of the device connector can be switched to an energized state. On the other hand, the case-side connector returns to the waiting state when the service cover is removed from the case to cut off the interlock circuit and the biasing member biases the case-side connector.

Two clearances may be formed at opposite sides of the case-side connector in the waiting state and both may have the same dimensions. According to this configuration, the case-side connector can be arranged in the center of the mounting recess in the waiting state. Thus, misalignment can be absorbed equally over the entire range regardless of a direction of the misalignment. More particularly, two larger and smaller clearances are formed at the opposite sides of the case-side connector if the case-side connector is not in the center of the mounting recess. The smaller clearance becomes smaller than the clearance in the case of arranging the case-side connector in the center of the mounting recess. Thus, the amount of absorption of the misalignment is reduced by an amount corresponding to a reduction in the clearance. However, clearances with the same dimensions are formed at opposite sides of the case-side connector of the invention and the absorption of the misalignment is not smaller at either side.

The biasing member may be a cantilevered flexible piece on the case-side connector and biases the case-side connector in a direction perpendicular to a connecting direction to the cover-side connector as the flexible piece resiliently contacts the inner wall of the mounting recess. The mounting recess may have an open rear end and a mounting hole may penetrate through a front end part of the mounting recess in the forward and backward connecting direction. In this regard, the end to be connected to the cover-side connector is considered the front end. The case-side connector may include a case-side housing mounted to pass through the mounting hole. A bulge projects laterally from an outer side surface of the case-side housing and can contact an edge of the mounting hole from behind. The flexible piece extends from a position behind the bulge on the outer side surface of the case-side housing to the vicinity of the front end of the mounting recess. The bulging may include an inclined surface that extends along a pivotal displacement path of a leading end part of the flexible piece when the leading end part of the flexible piece is displaced toward the outer side surface of the case-side housing.

The length of the flexible piece preferably is extended maximally to reduce rigidity and to make the flexible piece maximally flexible. In this respect, the flexible piece is long in forward and backward directions. Rigidity can be reduced more and the flexible piece can be made more flexible than when the flexible piece is short. On the other hand, a long flexible piece is more likely to interfere with the bulge. Accordingly, the leading end part of the flexible piece is displaced along the inclined surface and will not interfere with the bulge.

A contact rib may be provided on the leading end part of the flexible piece and may extend in forward and backward directions. The contact rib will come into line contact with the inner wall of the mounting recess. According to this configuration, the case-side connector moves laterally in parallel while being postured to extend in forward and backward directions by bringing the contact rib into line contact with the inner wall of the mounting recess. Thus, the case-side connector will not incline with respect to the cover-side connector and be connected forcibly in this posture.

The leading end of the flexible piece may be near a center of the case-side connector in forward and backward directions. Thus, the flexible piece stably biases the case-side connector in the lateral direction and can be moved more easily in parallel.

DETAILED DESCRIPTION OF THE PREFERRED EMBODIMENT

Figure 1:
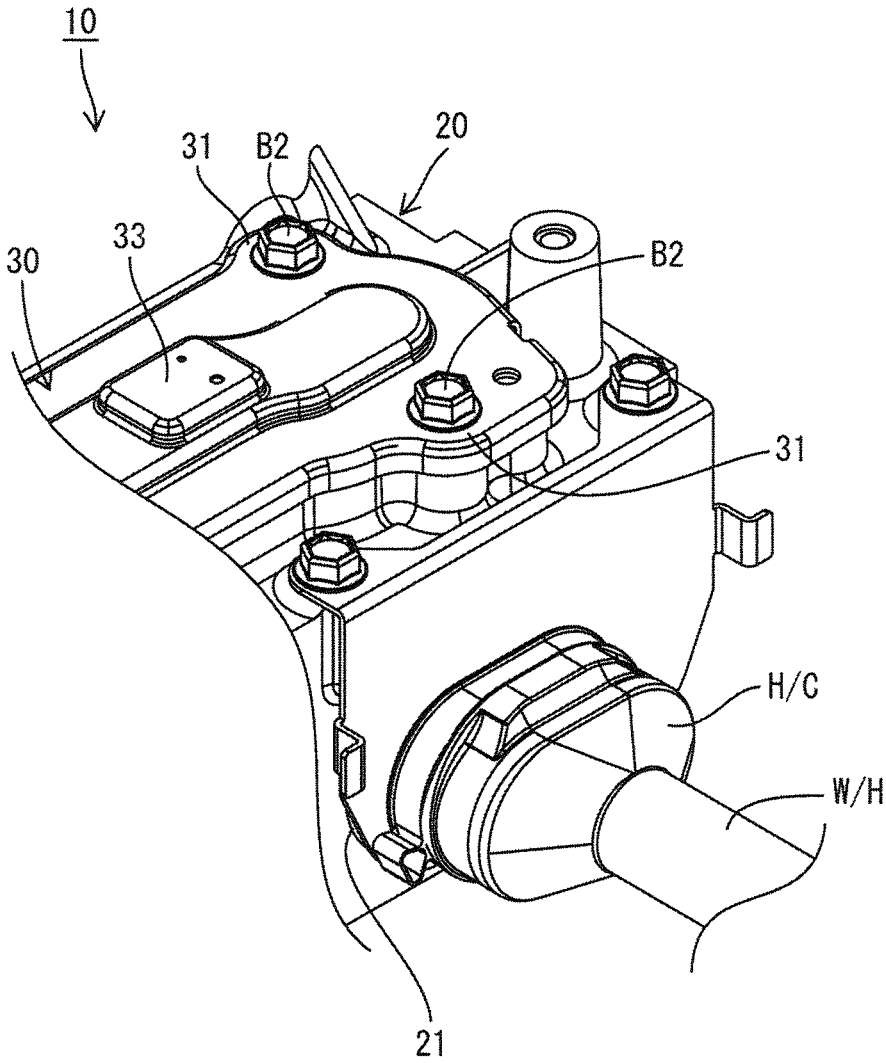
FIG. 1 is a perspective view of a device connector in an embodiment.

A device connector 10 of this embodiment has a connector connecting portion 21 connectable to a harness-side connector H/C at an end of a wiring harness W/H, as shown in FIG. 1. Only one connector connecting portion 21 is shown in FIG. 1, but the device connector 10 actually has plural connector connecting portions 21.

The device connector 10 has a metal case 20 and the connector connecting portion 21 extends through a side surface of the metal case 20. A terminal block 40 is arranged in the case 20 and a service hole 22 in the upper surface of this case 20 enables bolts of the terminal block 40 to be tightened. A service cover 30 is provided for closing the service hole 22 after the bolt tightening operation to seal the interior of the case 20.

Figure 4:
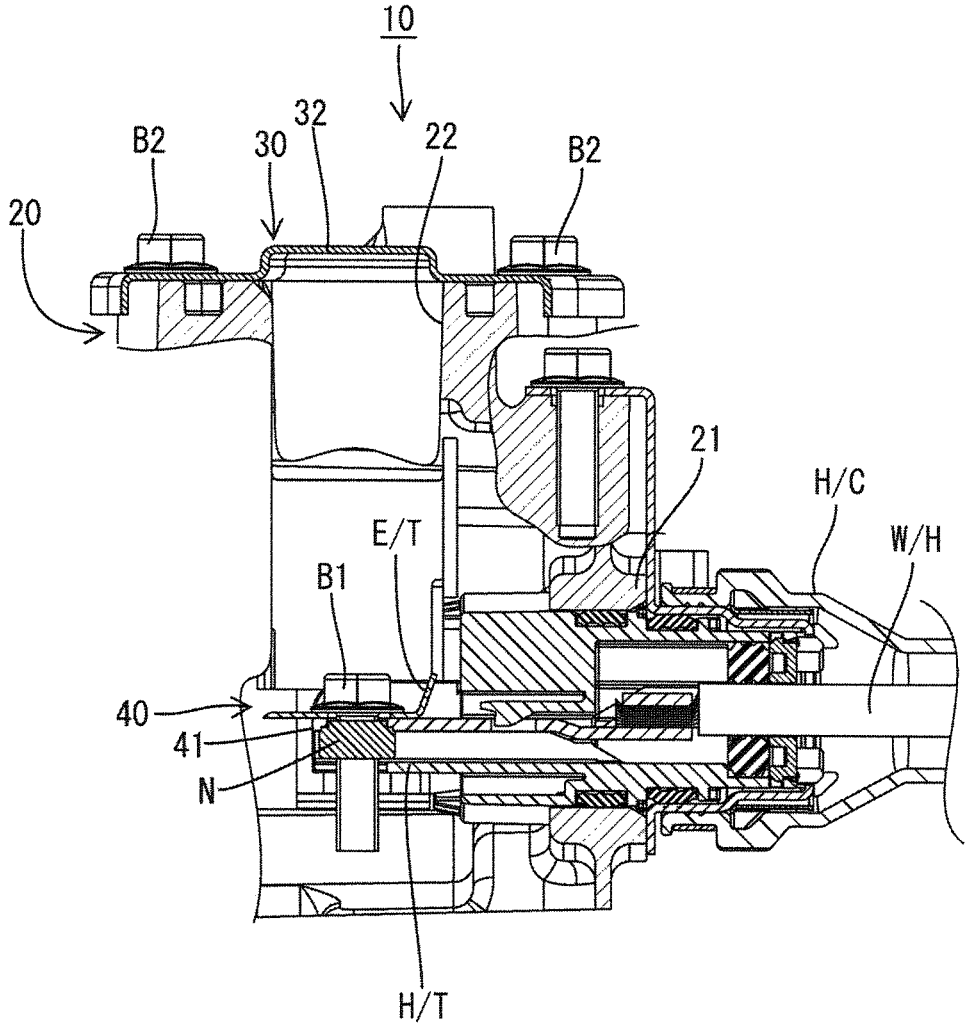
FIG. 4 is a section showing a terminal connecting structure of a terminal block.

As shown in FIG. 4, the harness-side connector H/C includes a harness-side terminal H/T crimped and connected to a core exposed by removing insulation coating at an end of the wiring harness W/H. The harness-side terminal H/T is flat and has a connection hole through which a bolt B1 is inserted. A device-side terminal E/T connected to the harness-side terminal H/T also has a connection hole through which the bolt B1 is inserted.

The terminal block 40 includes a tightening portion 41 in which a nut N is mounted in advance. The harness-side terminal H/T is placed on an upper seating surface of the nut N and the device-side terminal E/T is placed on the upper surface of the harness-side terminal H/T. The bolt B1 then is inserted through the respective connection holes and is tightened into the nut N. The service hole 22 is open above the nut N and can receive a tightening tool for tightening the bolt B1 into the nut N.

Although not shown, plural tightening portions 41 are provided in the case 20. On the other hand, the case 20 has one large service hole 22 that is used commonly for the respective tightening portions 41. The service cover 30 for closing the service hole 22 has a rectangular shape extending in a longitudinal direction of the case 20.

Plural mounting portions 31 are spaced apart around the peripheral edge of the service cover 30. Each mounting portion 31 is formed with a mounting hole through which a mounting bolt B2 is inserted. The service cover 30 is mounted and fixed to the upper surface of the case 20 by inserting the mounting bolts B2 through the mounting holes.

Figure 3:
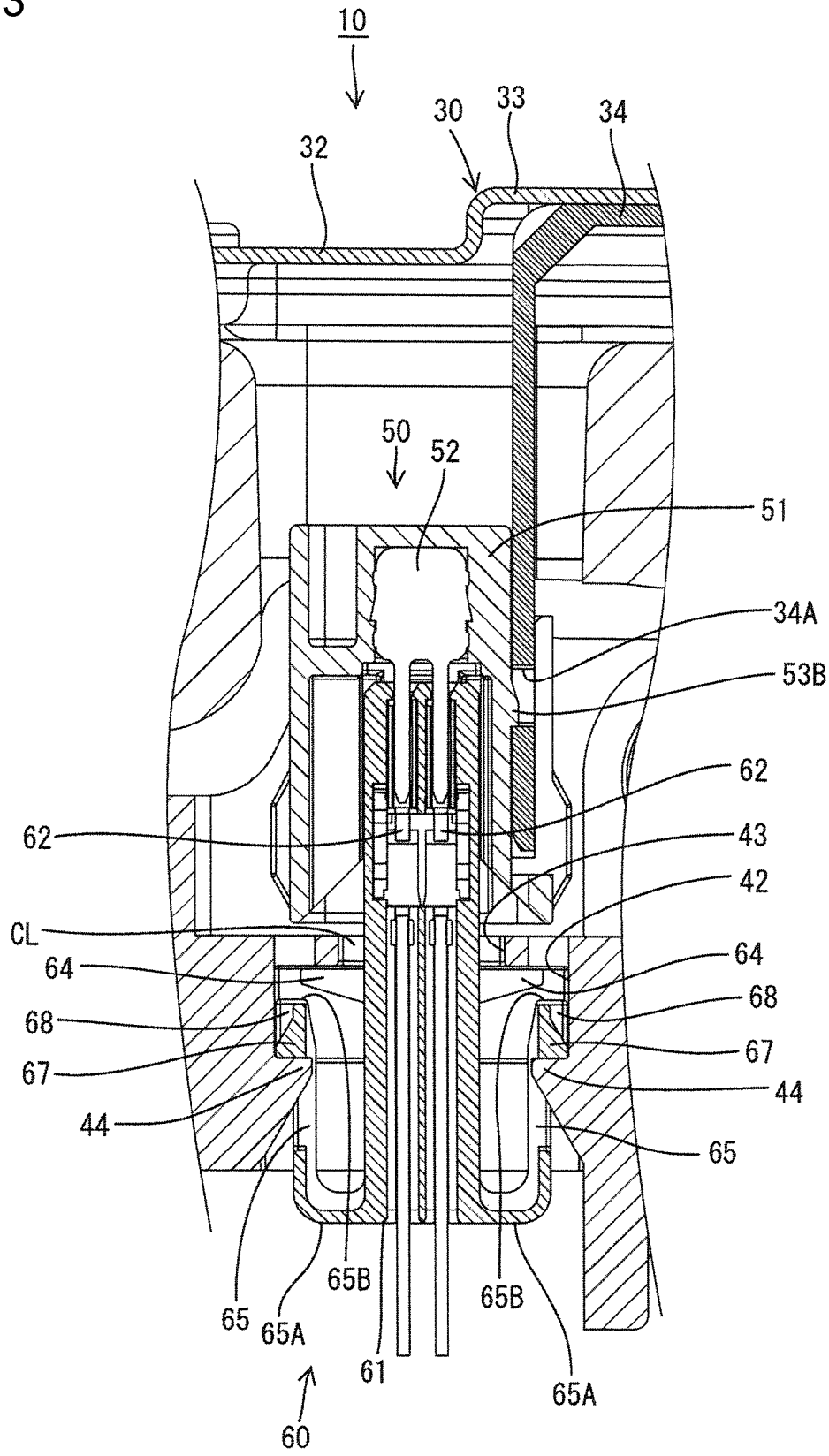
FIG. 3 is a section showing the connected state of the cover-side connector and the case-side connector when viewed perpendicular to a viewing direction of FIG. 2.

A bulge 32 projects up at a central part of the service cover 30 and has an outer shape slightly smaller than the service hole 22. The bulge 32 is formed by hammering a part of the service cover 30 to project up, and a mounting seat 33 projects farther up on the upper surface of the bulge 32. As shown in FIG. 3, a substantially L-shaped metal stay 34 is fixed integrally to the lower surface (inner surface) of the mounting seat 33 and a locking hole 34A is formed in a lower part of the stay 34.

A cover-side connector 50 is attached to the lower end part of the stay 34. This cover-side connector 50 includes a cover-side housing 51 and a shorting terminal 52 press-fit into the cover-side housing 51. The cover-side connector 50 is connectable to a case-side connector 60 mounted in the terminal block 40 in the case 20. The shorting terminal 52 electrically conductively connects to two female terminals 62 in the case-side connector 60 to form an interlock circuit when the connectors 50, 60 are connected.

An electrical circuit in the device is connected to the device-side terminal E/T and is switched to an energized state when the interlock circuit is formed (connected state), but is switched to a non-energized state when the interlock circuit is cut off (disconnected state). The connectors 50, 60 are separated when the service cover 30 is removed from the case 20 and hence the electrical circuit is not in the energized state even if the harness-side terminal H/T and the device-side terminal E/T are connected. On the other hand, the electrical circuit is in the energized state when the service cover 30 is mounted on the case 20 and the connectors 50, 60 are connected.

The service cover 30 is used for plural tightening portions 41 and is large. Thus, a mounting tolerance for mounting the service cover 30 on the case 20 must be large. To absorb this mounting tolerance, the mounting holes of the mounting portion 31 through which the mounting bolts B2 are inserted are made larger than the diameter of the shafts of the mounting bolts B2. Thus, the tightening operation can be performed after absorbing the mounting tolerance.

On the other hand, a misalignment is likely to occur between the connectors 50, 60 due to the mounting tolerance when connecting the connectors 50, 60. A connecting operation can be performed after the misalignment is absorbed by moving the case-side connector 60 in a direction perpendicular to a connecting direction of the connectors 50, 60. The detailed configurations of the connectors 50, 60 are described below. In the following description, the connecting direction of the connectors 50, 60 is referred to as forward and backward directions and ends that are connected are referred to as front ends.

Figure 10:
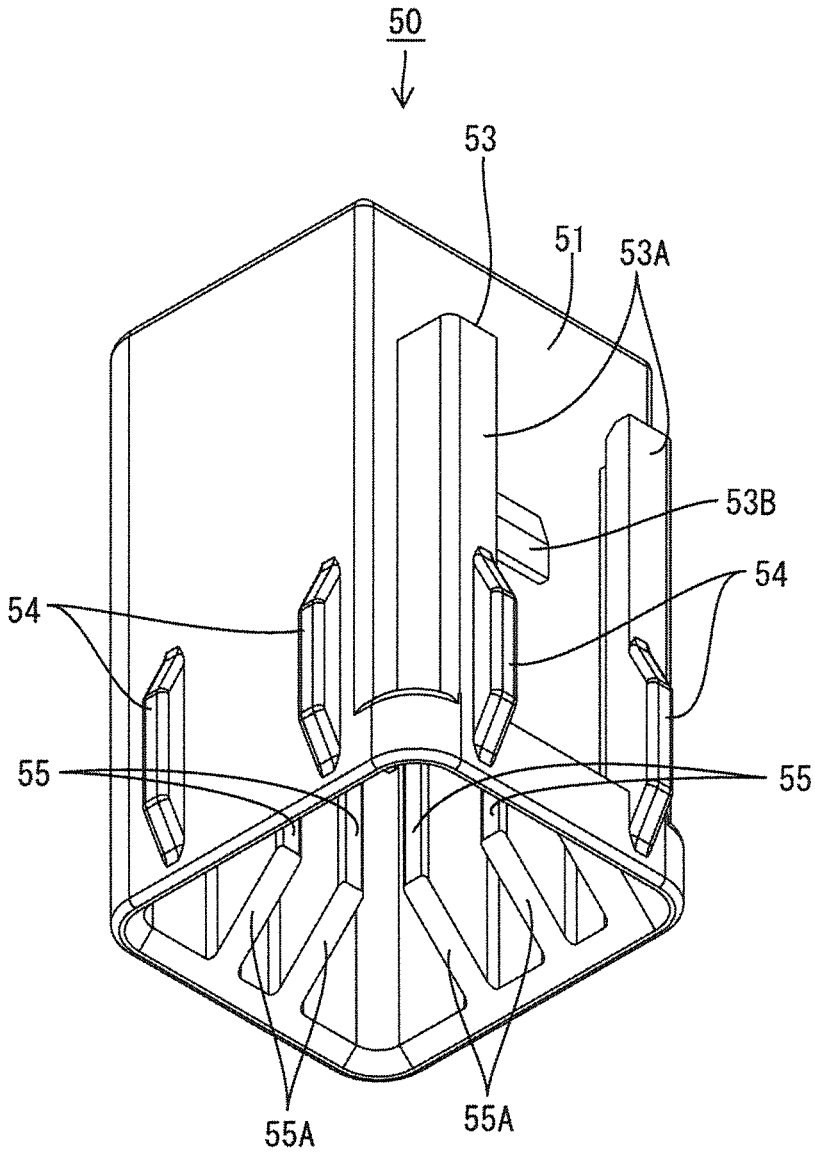
FIG. 10 is a perspective view showing the cover-side connector.

First, the cover-side connector 50 is described with reference to FIGS. 10 to 13. A stay mounting portion 53 is provided on an outer side surface of the cover-side connector 51, as shown in FIG. 10, and can receive the stay 34. The stay mounting portion 53 extends in forward and backward directions and includes two supporting rails 53A that engage lateral edges of the stay 34 to support the stay 34. A locking projection 53B is provided between the supporting rails 53A.

The locking projection 53B swiftly fits into the locking hole 34A of the stay 34 when the stay 34 is mounted into the stay mounting portion 53 and locks the stay 34 in forward and backward directions. The supporting rails 53A prevent the locked stay 34 from moving away from the cover-side housing 51 so that the cover-side housing 51 is held and retained on the stay 34.

Figure 11:
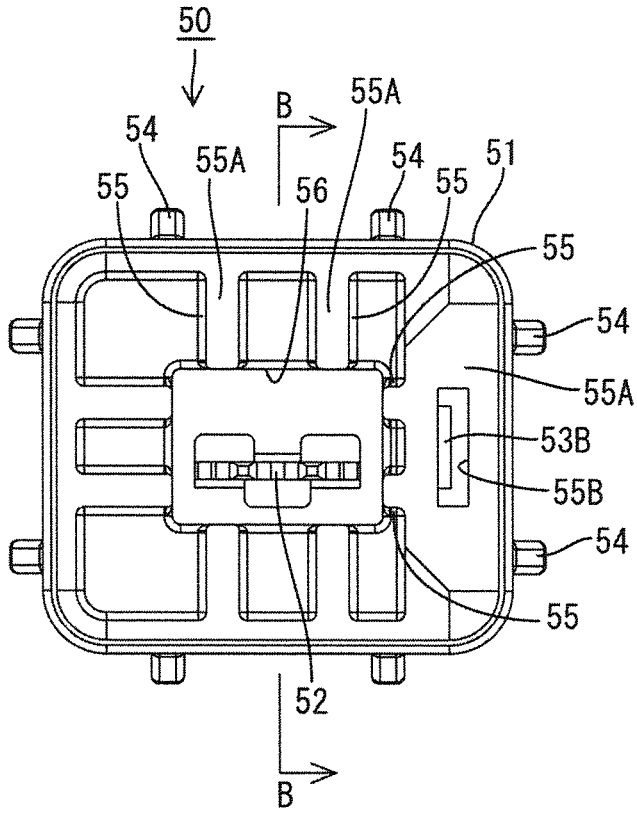
FIG. 11 is a bottom view of the cover-side connector.
Figure 12:
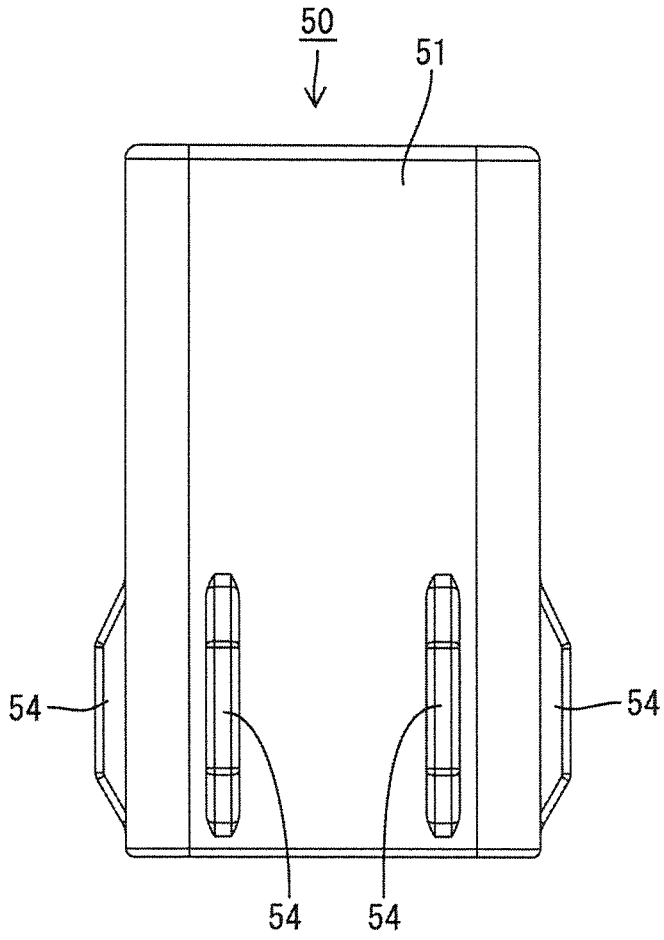
FIG. 12 is a left side view of the cover-side connector.
Figure 13:
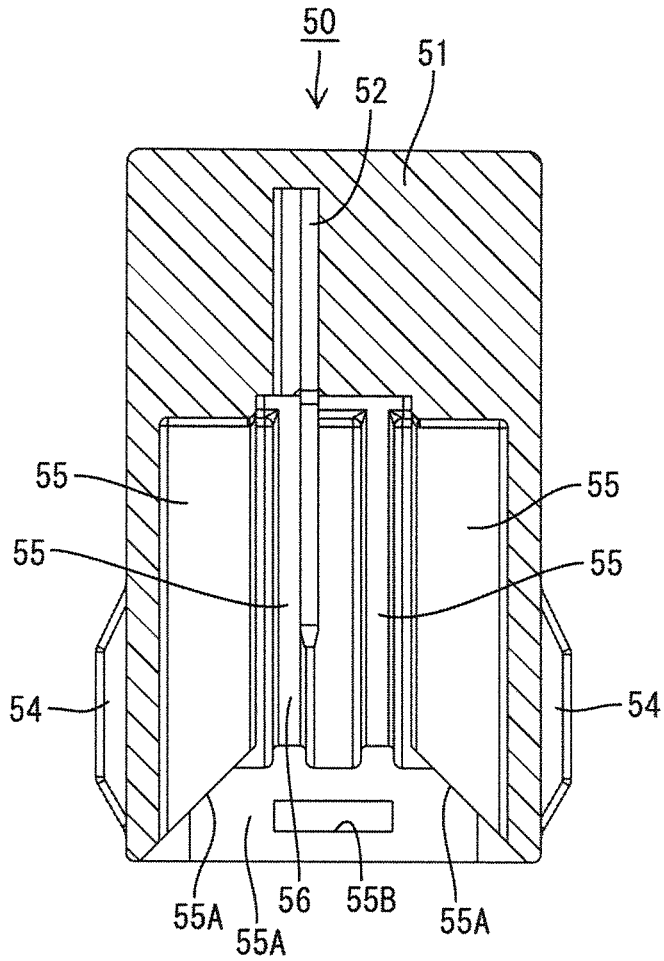
FIG. 13 is a section along B-B of FIG. 11.

Two parallel outer ribs 54 extend in forward and backward directions along each of the outer side surfaces of the cover-side housing 51. Front and rear ends of each outer rib 54 are tapered to form inclined surfaces. Inner ribs 55 likewise extend in forward and backward directions in the cover-side housing 51. A front part of each inner rib 55 is tapered to form a guiding surface 55A that comes closer to the outer side surface of the cover-side housing 51 toward the front. The two inner ribs 55 at a side where the locking projection 53B is provided have a smaller projecting height than the other inner ribs 55 as shown in FIG. 11. The guiding surface 55A is formed in the entire area between the inner ribs 55 and the outer side surface of the cover-side housing 51 excluding a mold removal hole 55B for the locking projection 53B.

A connection space 56 for receiving the case-side connector 60 is enclosed by the inner side surfaces of the inner ribs 55. The frontal dimensions of the connection space 56 are equal to or smaller than half those of the cover-side housing 51. Further, the connection space 56 is arranged on an axis line passing through the center of the cover-side housing 51. All of the guiding surfaces 55A located side by side at the opposite sides of the connection space 56 have the same dimension in their arrangement directions. Thus, even if there is a misalignment in any of the arrangement directions, the same amount of misalignment can be absorbed. Further, the amount of misalignment that can be absorbed by the guiding surfaces 55A exceeds a maximum misalignment amount calculated based on the mounting tolerance of the service cover 30.

Figure 2:
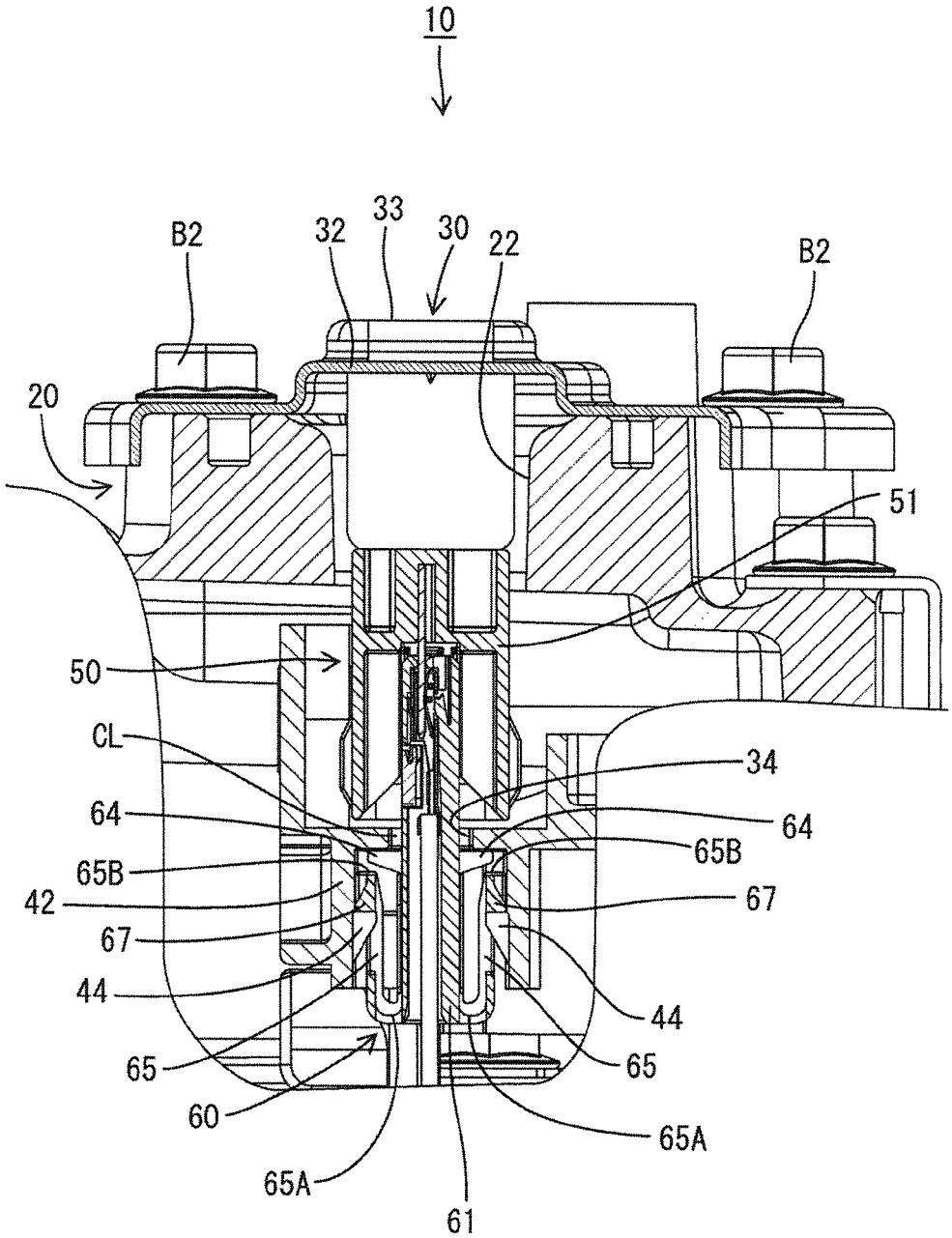
FIG. 2 is a section showing a connected state of a cover-side connector and a case-side connector.

The case-side connector 60 is mounted in a mounting recess 42 in the terminal block 40, as shown in FIG. 2 or 3. The mounting recess 42 has an open lower end and the case-side connector 60 is insertable into the mounting recess 42 from below. A mounting hole 43 penetrates through a front end of the mounting recess 42 and the case-side connector 60 is mounted so that the case-side housing 61 penetrates through the mounting hole 43. A predetermined clearance CL is provided over the entire circumference between the mounting hole 43 and the outer side surfaces of the case-side housing 61. The case-side connector 60 is movable within the range of the clearance CL, and a dimension of the clearance CL is the maximum misalignment amount that can be absorbed by the case-side connector 60.

Figure 5:
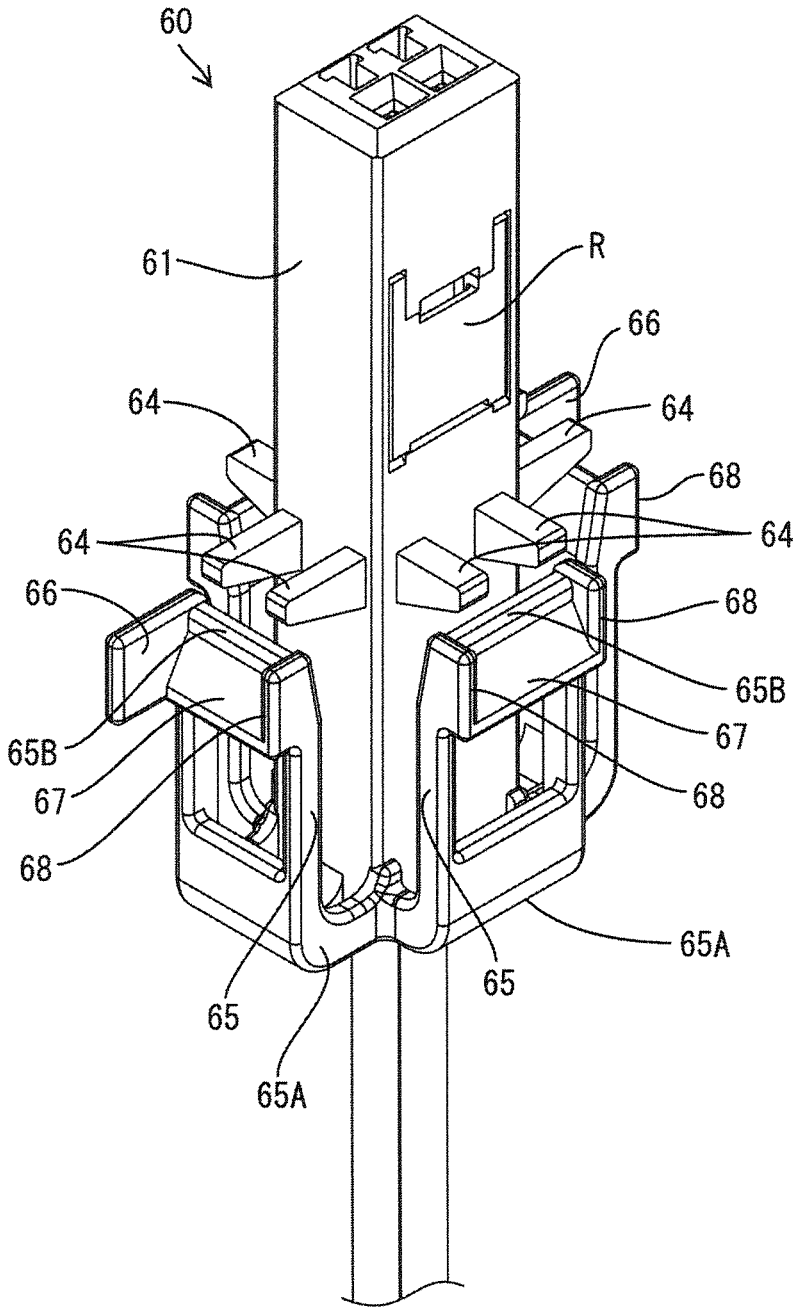
FIG. 5 is a perspective view of the case-side connector.
Figure 6:
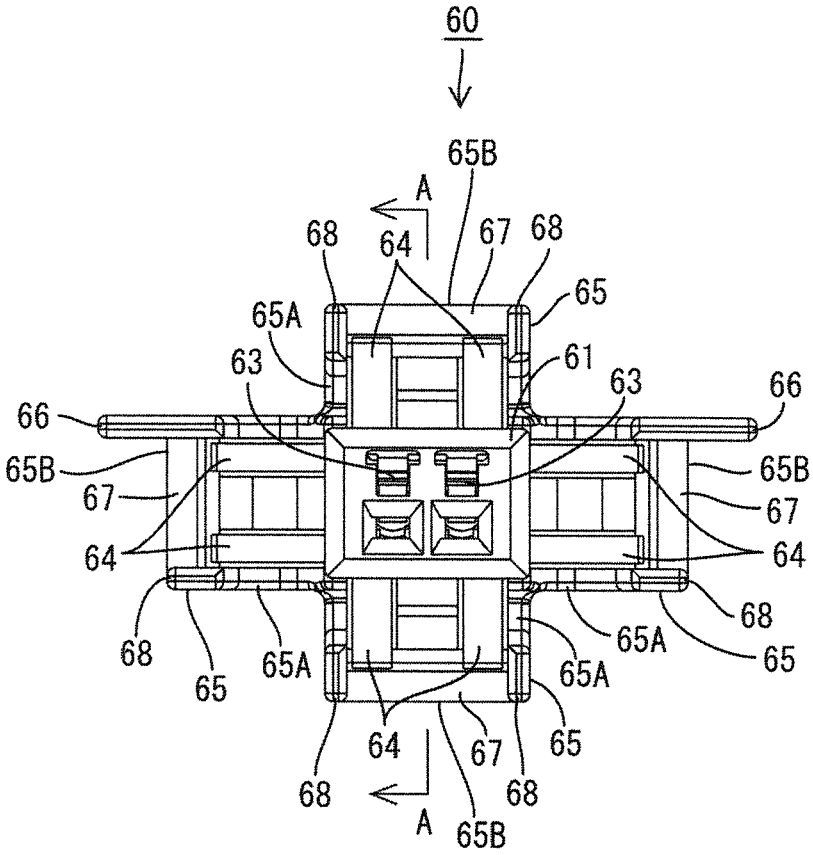
FIG. 6 is a plan view of the case-side connector.
Figure 7:
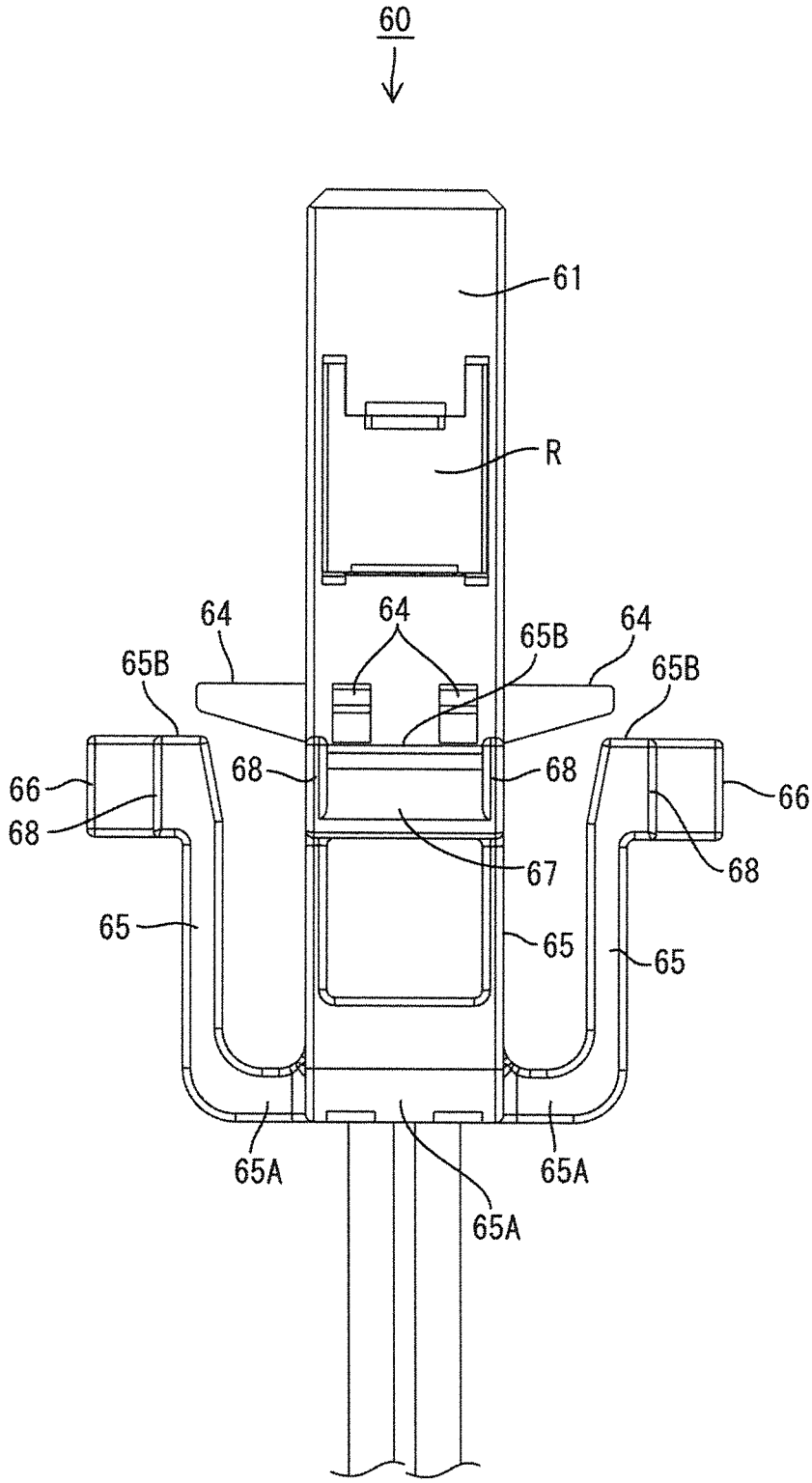
FIG. 7 is a front view of the case-side connector.
Figure 8:
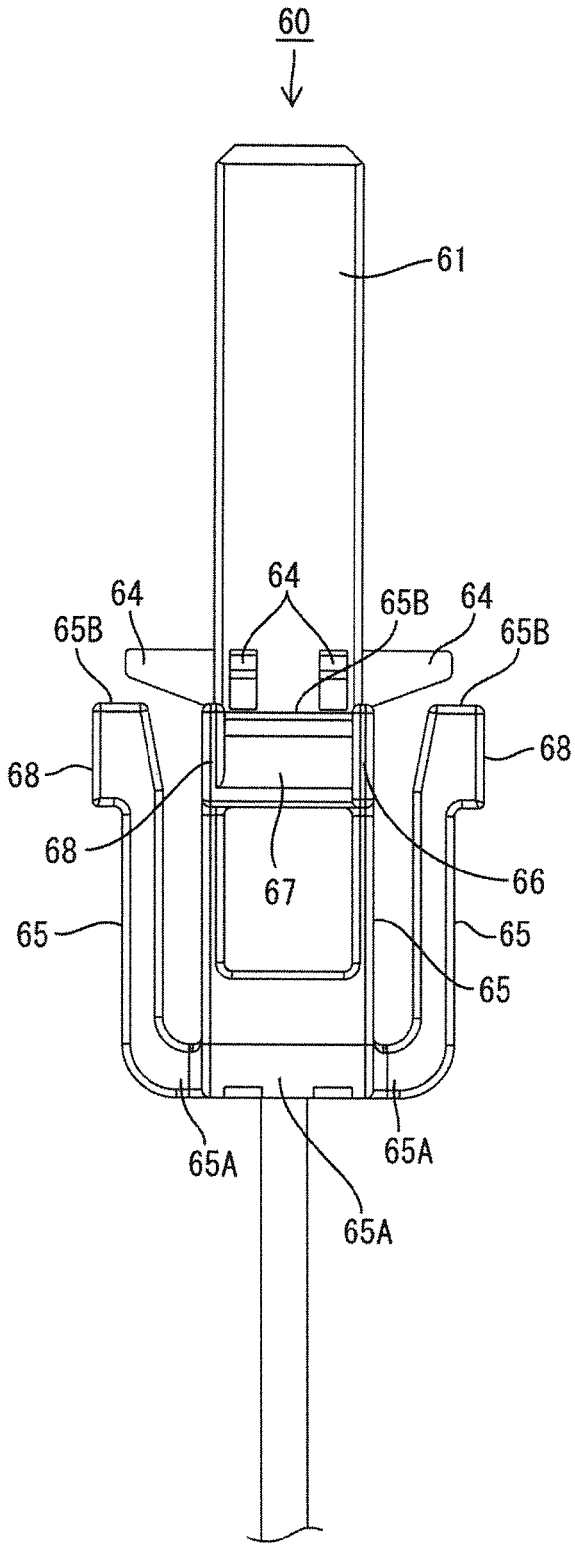
FIG. 8 is a right side view of the case-side connector.
Figure 9:
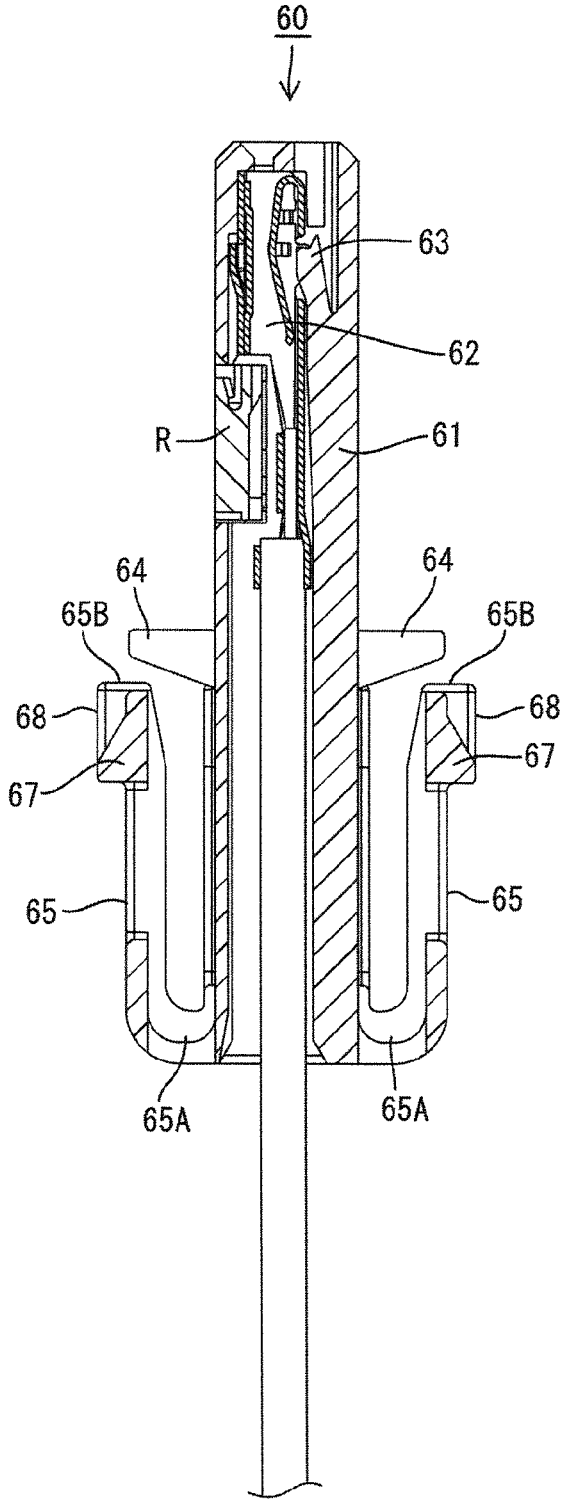
FIG. 9 is a section along A-A of FIG. 6.

As shown in FIG. 5, the case-side housing 61 is a substantially rectangular block long in forward and backward directions. A retainer mount hole is formed in the outer side surface of the case-side housing 61, and a retainer R is mounted into the retainer mount hole. As shown in FIG. 9, the female terminals 62 are accommodated in the case-side housing 61 and are locked doubly by locking lances 63 cantilevered in the case-side housing 61 and by the retainer R so as not to come out backward.

Two bulging pieces 64 bulge out laterally from each of the outer side surfaces of the case-side housing 61 at positions near a center of the case-side housing 61 in forward and backward direction, as shown in FIG. 5. The front surfaces of the bulging pieces 64 are perpendicular to the outer side surfaces of the case-side housing 61 and achieve surface contact with an edge of the mounting hole 53 from behind.

Resiliently deformable flexible pieces 65 are cantilevered on the outer side surfaces of the case-side housing 61. Each flexible piece 65 has a base 65A that extends perpendicularly from the outer side surface of the case-side housing 61 at a position behind the bulging pieces 64. Each flexible piece 65 then extends forward from the leading end of the base 65A parallel to the outer side surface of the case-side housing 61.

A leading end 65B of the flexible piece 65 is spaced sufficiently from the bulging pieces 64 to avoid interference when the flexible piece 65 is deformed. The leading end 65B moves slightly down and toward the case-side housing 61 as the flexible piece 65 pivots about the base 65A. Further, the rear surface of the bulging piece 64 is inclined parallel to a pivotal displacement path of the leading end 65B of the flexible piece 65. Thus, the leading end portion 65B of the flexible piece 65 does not interfere with the bulging pieces 64 when the flexible piece 65 is deformed about the base 65A.

Two holding projections 44 face each other on the inner side surfaces of the mounting recess 42. A retaining portion 67 is provided on the leading end portion 65B of the flexible piece 65 and is engageable with the holding projection 44 in forward and backward directions. Specifically, the flexible piece 65 has two arms extending forward from the base 65A, and the leading ends of the arms are coupled by the retaining portion 67. Accordingly, a holding hole is enclosed by the retaining portion 67, the arms and the base 65A and can receive the holding projection 44. As shown in FIG. 3, the retaining portions 67 and the holding projections 44 engage in a vertical mounting direction of the case-side connector 60 into the mounting recess 42 so that the case-side connector 60 is held and retained in the mounting recess 42.

Two contact ribs 68 are provided at the opposite sides of the retaining portion 67 on the leading end 65B of the flexible piece 65 and project more laterally than the arms of the flexible piece 65. The contact ribs 68 extend in forward and backward directions, and are arranged in parallel to the outer side surface of the case-side housing 61.

One of the contact ribs 68 extends laterally to form a flange 66 on the leading ends 65B of two of the four facing flexible pieces 65. The flanges 66 fit into guiding grooves (not shown) in the inner surfaces of the mounting recess 42 to guide the case-side connector 60 into the mounting recess 42.

The service cover 30 is removed from the case 20 to expose the respective tightening portions 41 to the outside through the service hole 22. Subsequently, the harness-side connector H/C is connected to the connector connecting portion 21 and the device-side terminal E/T and the harness-side terminal H/T are placed one on the other. The tightening tool then is inserted through the service hole 22 and into the case 20 to tighten the bolt B1 into the nut N. Thus, the terminals E/T, H/T are connected electrically connected at the tightening portion 41 to set a state where power can be supplied into the device. However, the interlock circuit is cut off and set in the OFF state before the service cover 30 is mounted on the case 20 and the electrical circuit in the device is in the non-energized state.

The service cover 30 then is mounted on the case 20 to close the service hole 22. At this time, the cover-side connector 50 may be misaligned with respect to the case-side connector 60 in a waiting state. However, a front part of the case-side housing 61 of the case-side connector 60 slides in contact with the guiding surfaces 55A of the cover-side housing 51 of the cover-side connector 50. As a result, the case-side housing 61 is fit into the connection space 56 while absorbing the misalignment by moving laterally to be coaxial with the cover-side housing 51. The flexible pieces 65 deform resiliently during this connecting operation, with the contact ribs 68 on the leading ends 65B of the flexible pieces 65 held in line contact with the inner wall of the mounting recess 42. Thus, the case-side housing 61 moves laterally in parallel.

The shorting terminal 52 and the female terminals 62 connect electrically conductively to form the interlock circuit and set the ON state when the connectors 50, 60 are connected properly. Thus, the electrical circuit in the device is set in the energized state. Subsequently, the mounting bolts B2 are inserted through the mounting holes of the mounting portions 31 on the peripheral edge of the service cover 30 to bolt the service cover 30 on the case 20, thereby fixing the service cover 30 to the case 20 and closing the service hole 22. The connectors 50, 60 separate if the service cover 30 is removed from the case 20. The resilient forces of the flexible pieces 65 then automatically center the case-side housing 61 in the mounting recess 42 at the waiting state in preparation for the next connecting operation.

As described above, the connectors 50, 60 can be connected properly by absorbing the misalignment of the connectors 50, 60 even if a large service hole 22 for plural tightening portions 41 is covered by one service cover 30. Accordingly, it is possible to normally operate the interlock circuit and switch the electrical circuit in the device to the energized state. Further, both connectors 50, 60 are in the center of the mounting recess 42. Thus, the misalignment can be absorbed reliably within the range of the clearance CL regardless of a direction of the misalignment of the both connectors 50, 60.

The flexible pieces 65 are as long as possible and the leading ends 65B do not interfere with the rear surfaces of the bulging pieces 64 when the flexible pieces 65 are deformed resiliently. Thus, the rigidity of the flexible pieces 65 is reduced. Accordingly, the flexible pieces 65 can be deformed more easily and connection resistance between the connectors 50, 60 is low. Further, the contact ribs 68 on the leading ends 65B of the flexible pieces 65 come into line contact with the inner wall of the mounting recess 42. Therefore, the case-side housing 61 can be moved laterally in parallel and the connection of the both connectors 50, 60 in improper connection postures can be avoided. Furthermore, the contact ribs 68 are near the center of the case-side housing 61 in forward and backward directions. Hence, biasing forces produced by resilient deformations of the flexible pieces 65 act on the case-side housing 61 in a well-balanced manner.

The present invention is not limited to the above described and illustrated embodiment. For example, the following embodiments are also included in the technical scope of the present invention.

Although the flexible piece 65 is illustrated as a biasing member in the above embodiment, a coil spring may be used as the biasing member according to the present invention. In this case, one end of the coil spring may be held in contact with the case-side housing 61 and the other end thereof may be held in contact with the terminal block 40 at an arbitrary position outside the mounting recess 42.

Although the clearance CL formed between the mounting hole 43 and the outer side surfaces of the case-side housing 61 is illustrated as a clearance secured between the case-side connector 60 and the inner wall of the mounting recess 42 in the above embodiment, it may be a clearance formed between an inner side wall extending in forward and backward directions out of the inner wall of the mounting recess 42 and the outer side surface of the case-side housing 61 according to the present invention.

Although the case-side connector 60 moves only laterally to absorb the misalignment in the above embodiment, it may move also in forward and backward directions and be floating-supported to absorb the misalignment according to the present invention.

Although the cantilever-shaped flexible pieces 65 extending forward are illustrated in the above embodiment, cantilever-shaped flexible pieces extending backward may be adopted according to the present invention.

Although the rear surfaces of the bulging pieces 64 are the inclined surfaces in the above embodiments, the leading end portions of the flexible pieces may be arranged somewhat backward and the rear surfaces of the bulging pieces may be surfaces perpendicular to the connecting direction of the both connectors 50, 60 according to the present invention.

Although the leading end portions 65B of the flexible pieces 65 are arranged near the center of the case-side housing 61 in forward and backward directions in the above embodiment, they may be arranged near the front end of the case-side housing according to the present invention.

What is claimed is:

1. A device connector provided in a case of a device in a vehicle, the case being formed with an opening used for a bolt tightening operation for a terminal block provided in the case, comprising:

a service cover to be mounted on the case to close the opening;

a case-side connector arranged in the case and mounted in a mounting recess provided in the terminal block;

a cover-side connector integrally provided on the service cover and connected to the case-side connector in a waiting state to form an interlock circuit when the service cover is mounted on the case; and a biasing member that holds the case-side connector to secure a clearance between the case-side connector and inner walls of the mounting recess when the case-side connector is in the waiting state and biases the case-side connector to return the case-side connector to the waiting state when the clearance changes.

2. The device connector of claim 1, wherein two substantially equally dimensioned clearances are formed respectively at the opposite sides of the case-side connector in the waiting state.

3. The device connector of claim 2, wherein:

the biasing member comprises at least one flexible piece cantilevered on the case-side connector and biases the case-side connector in a direction perpendicular to a connecting direction to the cover-side connector by resilient contact of the flexible piece with the inner wall of the mounting recess.

4. The device connector of claim 3, wherein:

the case-side connector has a front end for connection with the cover-side connector and a rear end opposite the front end, the mounting recess having an open rear end and a mounting hole penetrating through a front end part of the mounting recess in forward and backward directions;

the case-side connector (60) includes a case-side housing mounted to pass through the mounting hole.

5. The device connector of claim 4, further comprising at least one bulging piece projecting laterally from an outer side surface of the case-side housing and contacting an edge of the mounting hole from behind.

6. The device connector of claim 5, wherein the flexible piece extends from a position behind the bulging piece on the outer side surface of the case-side housing toward a front part of the mounting recess.

7. The device connector of claim 6, wherein:

the bulging piece includes an inclined surface that extends along a pivotal displacement path of a leading end part of the flexible piece when the leading end part of the flexible piece is displaced toward the outer side surface of the case-side housing.

8. The device connector of claim 3, wherein a contact rib extends in forward and backward directions on the leading end of the flexible piece and comes into line contact with the inner wall of the mounting recess.

9. The device connector of claim 3, wherein the leading end of the flexible piece is arranged near a center of the case-side connector in forward and backward directions.

10. The device connector of claim 3, wherein:

the case-side housing is substantially rectangular and has four outer side surfaces, the at least one flexible piece comprises four flexible pieces disposed respectively on the four outer side surfaces of the case-side housing.

* * * * *